US007080746B2

(12) United States Patent
Saito et al.

(10) Patent No.: US 7,080,746 B2
(45) Date of Patent: Jul. 25, 2006

(54) PINCH GRIP TYPE BOTTLE-SHAPED CONTAINER

(75) Inventors: Hiromichi Saito, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/490,256

(22) PCT Filed: Sep. 24, 2002

(86) PCT No.: PCT/JP02/09775

§ 371 (c)(1),
(2), (4) Date: Oct. 20, 2004

(87) PCT Pub. No.: WO03/026974

PCT Pub. Date: Apr. 3, 2003

(65) Prior Publication Data

US 2005/0040132 A1 Feb. 24, 2005

(30) Foreign Application Priority Data

Sep. 26, 2001 (JP) ..... 2001-293421

(51) Int. Cl.
*B65D 1/02* (2006.01)
*B65D 23/10* (2006.01)

(52) U.S. Cl. ..... 215/381; 215/384; 215/398; 220/666; 220/669; 220/771

(58) Field of Classification Search ..... 215/379, 215/383, 384, 381, 398; 220/666, 669, 771, 220/675

See application file for complete search history.

(56) References Cited

U.S. PATENT DOCUMENTS

| | | | | |
|---|---|---|---|---|
| 4,993,565 | A * | 2/1991 | Ota et al. | 215/384 |
| 5,092,474 | A * | 3/1992 | Leigner | 215/381 |
| 5,141,120 | A * | 8/1992 | Brown et al. | 215/381 |
| 5,226,550 | A * | 7/1993 | Mikolaitis et al. | 215/384 |
| 5,472,105 | A | 12/1995 | Krishnakumar et al. | |
| 5,971,184 | A | 10/1999 | Krishnakumar et al. | |
| 6,223,920 | B1 * | 5/2001 | Lane et al. | 215/384 |
| 6,277,321 | B1 * | 8/2001 | Vailliencourt et al. | 264/529 |
| 6,837,390 | B1 * | 1/2005 | Lane et al. | 215/381 |

FOREIGN PATENT DOCUMENTS

| | | |
|---|---|---|
| EP | 1 002 732 A1 | 5/2000 |
| JP | A 62-137207 | 6/1987 |
| JP | U-62-137207 | 8/1987 |
| JP | A 4-10009 | 1/1992 |
| JP | U-4-10009 | 1/1992 |
| JP | A 7-76333 | 3/1995 |

(Continued)

*Primary Examiner*—Sue A. Weaver
(74) *Attorney, Agent, or Firm*—Oliff & Berridge, PLC

(57) ABSTRACT

A bottle-shaped container according to the present invention is of pinch grip type and includes a container body having opposed recesses formed at sidewall regions of a main body portion of the container body, respectively, to thereby form a grip part of the container by an entire region of the main body portion between the recesses, including the back surface region. The bottle-shaped container further includes a pressure-reduction absorbing panel at the back surface region, having an upper end arranged at a height substantially coincident with that of an upper end of the grip part, and steps provided along the edges of the recesses forming the grip part, respectively.

4 Claims, 4 Drawing Sheets

FOREIGN PATENT DOCUMENTS

| | | |
|---|---|---|
| JP | A 8-11889 | 1/1996 |
| JP | A 8-324534 | 12/1996 |
| JP | A 2002-154517 | 5/2002 |
| JP | A 2002-160717 | 6/2002 |

* cited by examiner

PINCH GRIP TYPE BOTTLE-SHAPED CONTAINER

BACKGROUND ART

1. Technical Field

The present invention relates to a so-called pinch grip type bottle-shaped container, which is formed with opposed recesses at a main body portion of the container body such that the recesses are used as a grip part for gripping the container, and intends to advantageously avoid lowering of the mechanical strength due to a light-weighted or thin-walled nature of the container.

2. Related Art

Synthetic resin containers, such as PET bottles, have been widely used as containers, e.g., for filling therein foods, beverages, cosmetics or medicines, since such containers are light in weight and can thus be easily handled, have transparency to exhibit a refined appearance comparable to glass containers, and can be produced at low cost.

Synthetic resin containers have a relatively low mechanical strength against external forces. Therefore, when the container is gripped at its main body portion for pouring the contents out of the container, the container inevitably undergoes deformation at its gripped part.

It is thus a typical countermeasure to appropriately control the container wall thickness and form longitudinal ribs, lateral ribs or waists (i.e., circumferential grooves surrounding the main body portion) so as to improve the resistances of the container to external forces, such as rigidity, buckling strength, etc.

However, there is an increasing demand for thin-walled (or light-weighted) containers so as to reduce the resin amount to be used per one container from a standpoint of effective utilization of resources and reduction in the amount of wastes, resulting in a situation where the strength of the container is inevitably further lowered in order to deal with such a demand.

Particularly, in the case of pinch grip type large-sized containers, which have been recently used widely as large-sized containers having a filling volume of not less than 2.7 liters, for containing therein Japanese "sake", soy sauce, edible oil, Japanese "shochu" (distilled spirit), whisky, etc., when it is desired to realize light-weighted structure, the container main body portion including the grip part inevitably undergoes deformation when gripped at the grip part.

DISCLOSURE OF THE INVENTION

It is therefore an object of the present invention to provide an improved pinch grip type bottle-shaped container capable of retaining its initial shape even when the container is light-weighted and thin-walled.

According to the present invention, there is provided a pinch grip type bottle-shaped container comprising a container body having opposed recesses formed at sidewall regions of a main body portion of the container body, respectively, to thereby form a grip part of the container by an entire region of the main body portion between the recesses, including the recesses themselves and a back surface region of the main body portion, wherein the bottle-shaped container further comprises: a pressure-reduction absorbing panel at said back surface region, said pressure-reduction absorbing panel having an upper end arranged at a height substantially coincident with that of an upper end of said grip part; and steps provided along the edges of said recesses forming said grip part, respectively.

The bottle-shaped container according to the present invention may be provided with a lateral rib having a groove located at a boundary between the upper end of the pressure-reduction absorbing panel in the back surface region, and the main body portion of the container body, so that the groove is convex inwardly of the container.

Furthermore, the bottle-shaped container according to the present invention may be provided with pressure-reduction absorbing panels at its shoulder part.

BRIEF DESCRIPTION OF THE DRAWINGS

The present invention will be described in further detail hereinafter, with reference to a preferred embodiment shown in the drawings.

BEST MODE FOR CARRYING OUT THE INVENTION

Figure 1:
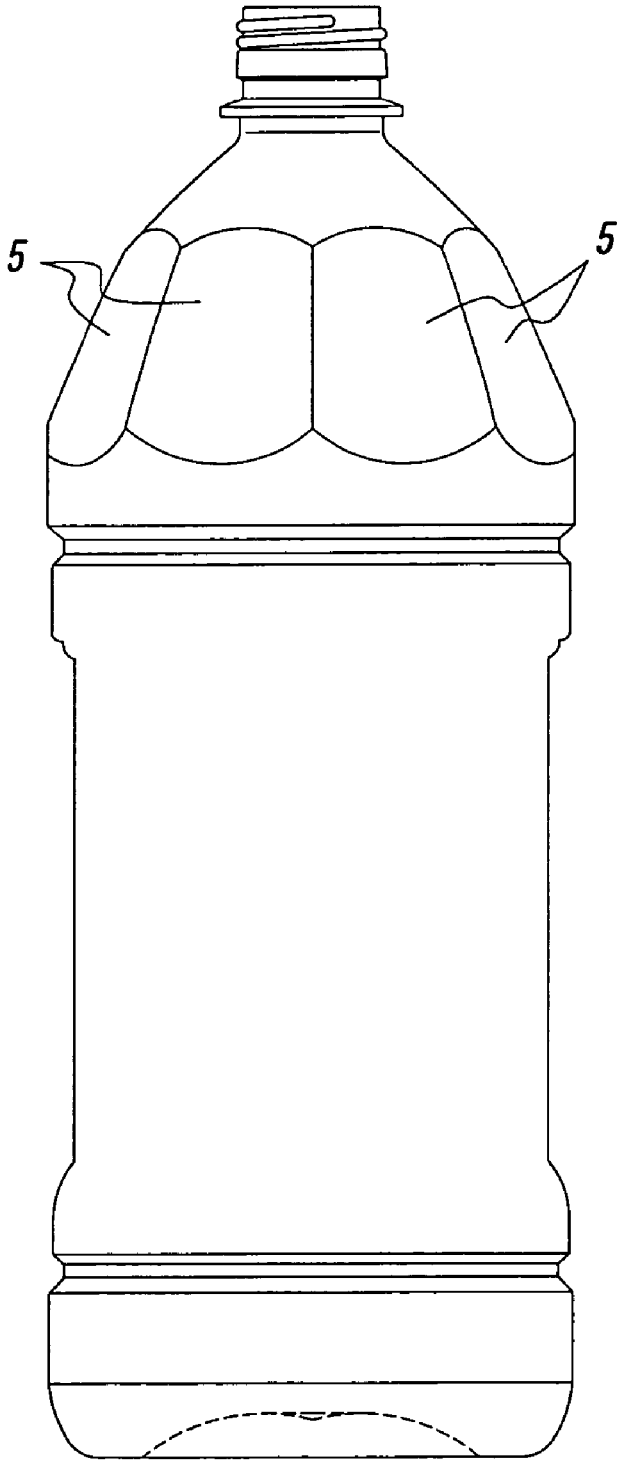
FIG. 1 through FIG. 3 are front view, side view and rear view, respectively, of a bottle-shaped container according to one embodiment of the present invention.
Figure 2:
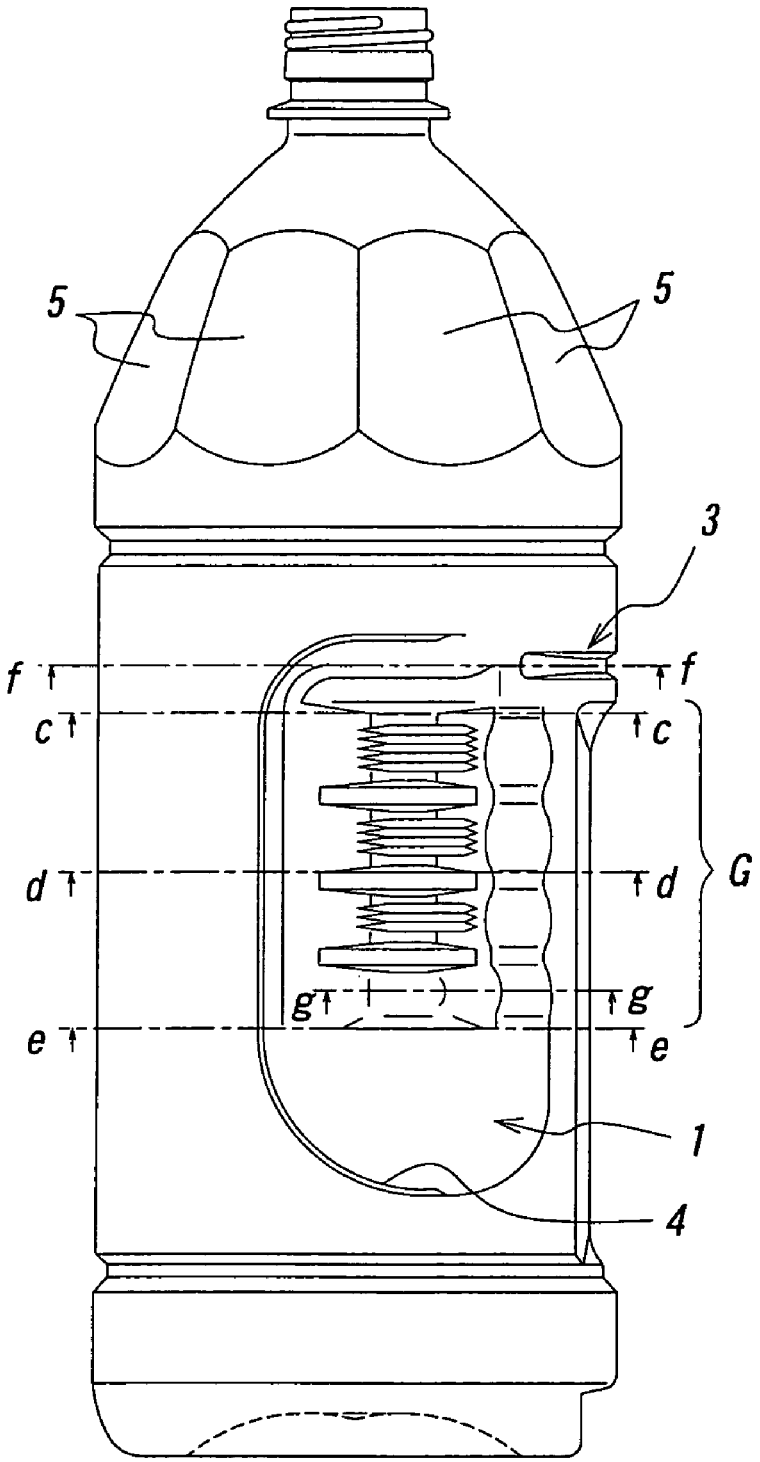
Figure 3:
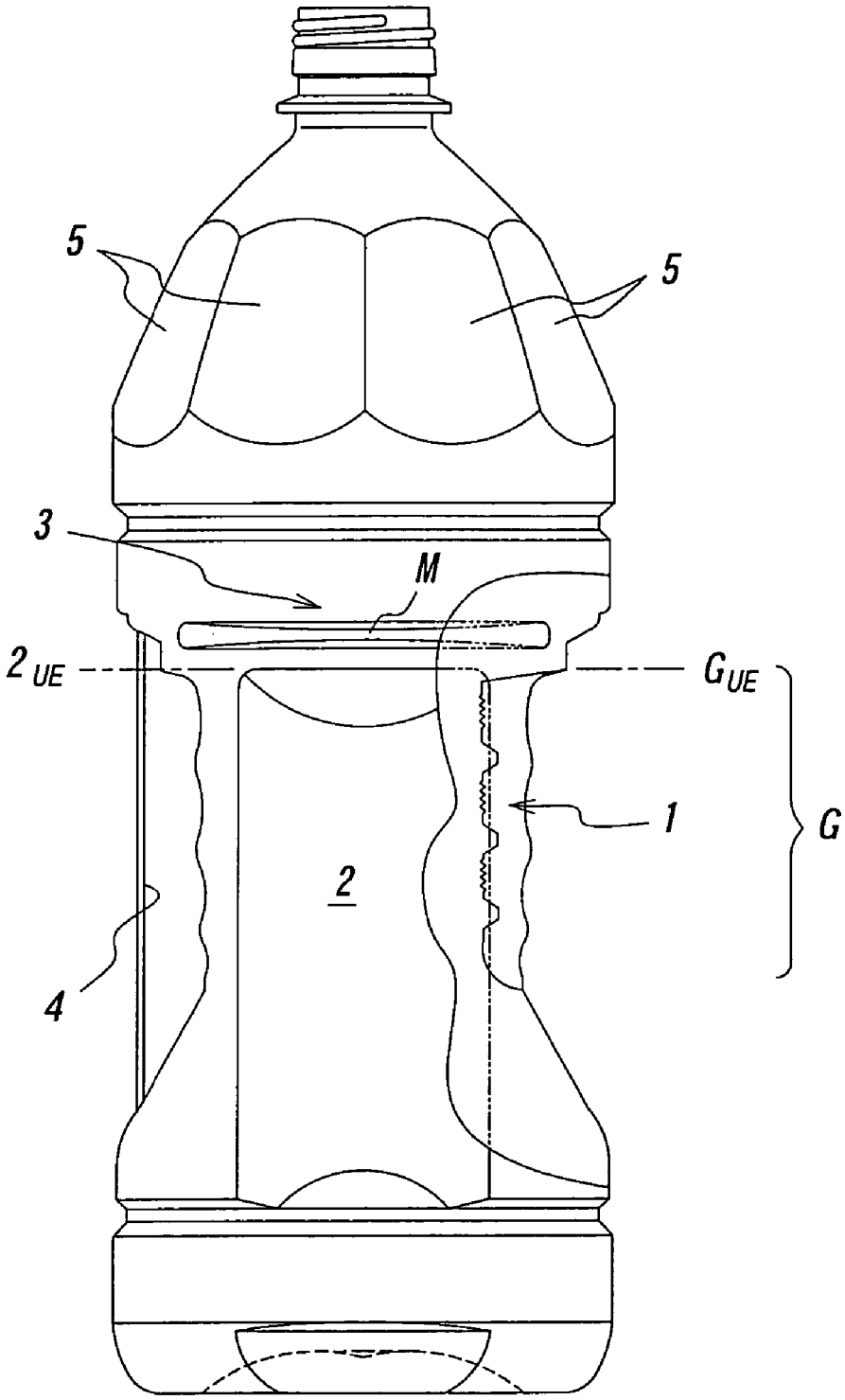

In FIGS. 1 through 3, reference numerals 1 denotes recesses that are formed in sidewall regions of a container main body portion so as to be opposed to each other, and reference numeral 2 denotes a pressure-reduction absorbing panel provided in a back surface region between the recesses 1 so as to prevent deformation of the container due to a pressure reduction within the container. There is formed a grip part G, by the entire region from one recess 1 to the other recess 1, inclusive of these recesses themselves and the pressure-reduction absorbing panel 2. This kind of grip part G may also be called as "pinch grip".

Furthermore, reference numeral 3 denotes a lateral rib having a groove M located at a boundary between the upper end of the pressure-reduction absorbing panel 2 and the container main body portion such that the groove is convex inwardly of the container, reference numerals 4 denotes steps provided along the edges of the recesses 1 forming the grip part G, respectively, and reference numerals 5 denotes pressure-reduction absorbing panels, respectively, provided at a shoulder part of the container body.

The bottle-shaped container shown in FIG. 1 through FIG. 3 is of a widely used type having a filling volume of 2.7 liters, and it is typical to use about 101 grams of resin for molding such a container. However, when the used resin amount is reduced to about 85 grams, for example, so as to reduce the weight of such container, the mechanical strength of the grip part G is considerably lowered so that the grip part G is significantly deformed when the container is gripped, and distortion tends to occur in the front surface of the container due to the deformation of the grip part G.

Nonetheless, according to the present invention, the grip part G has an upper end $G_{UE}$ arranged at a height substantially coincident with that of an upper end $2_{UE}$ of the pressure-reduction absorbing panel 2 (see FIG. 3), and the lateral rib 3 is provided to have the groove M. Therefore, it is possible to improve the gripping ability, enhance the rigidity at that region, and significantly reduce the deformation upon gripping the grip part G. It is to be noted that the lateral rib 3 may be omitted when the region of the main body portion above the pressure-reduction absorbing panel 2 is narrow and has a shape capable of ensuring certain degree of rigidity.

Figure 4:
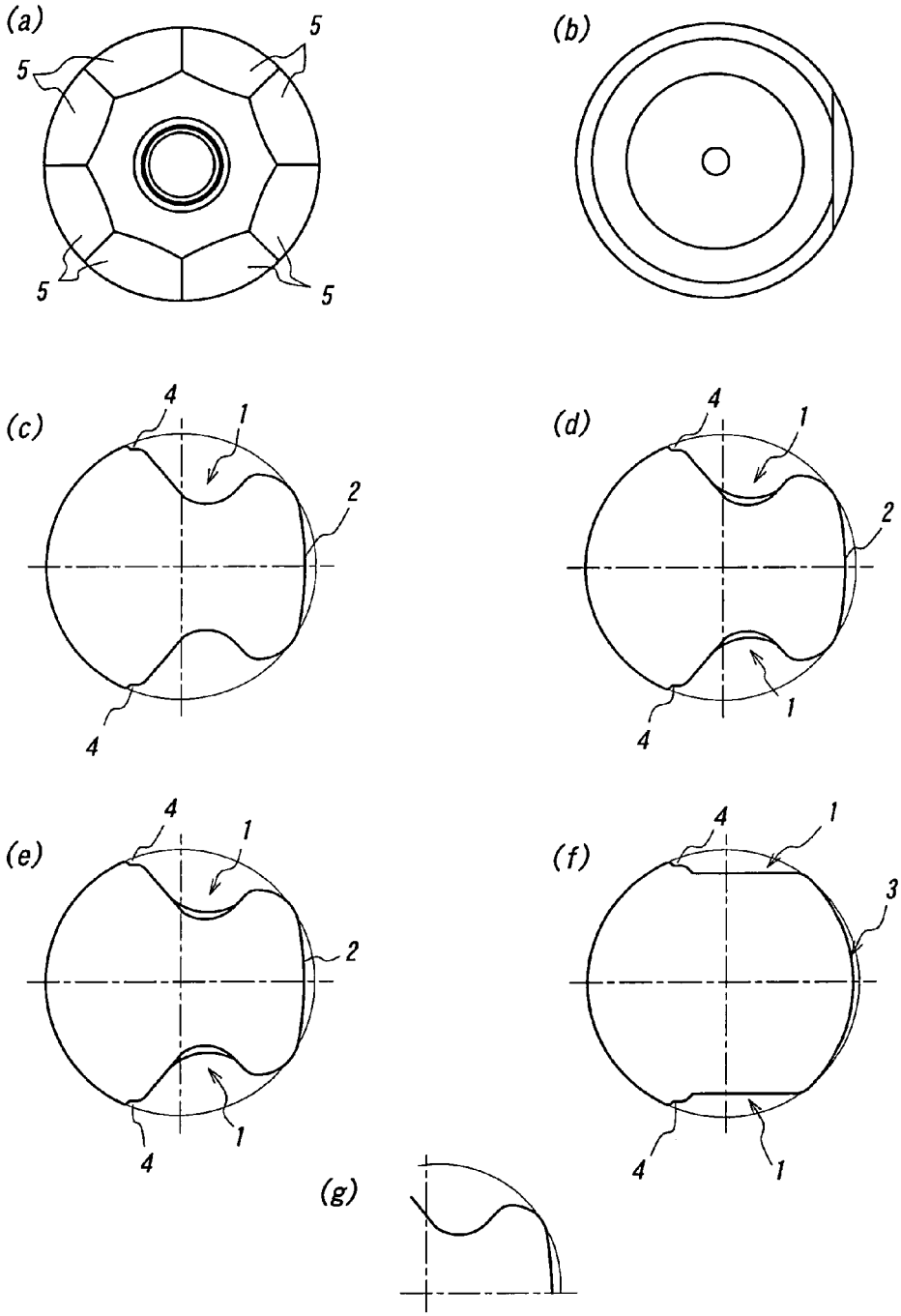
FIG. 4(*a*) and FIG. 4(*b*) are plan view and bottom view of the container of FIG. 1, respectively, and FIGS. 4(*c*) through (*g*) are cross-sectional views taken along line c—c through line g—g of FIG. 1, respectively.

Furthermore, the steps 4 (see FIGS. 4(*c*) through (*f*)) provided along the edges of the recesses 1 exhibit functions for enhancing the rigidity of the boundaries between the recesses 1 and the container main body portion, thereby restricting a deformation of that front surface of the container body main body portion, which, for example, is to be adhered with a label (not shown). This is because the front surface of the container is always kept in a tightened state, whether the grip part is gripped or not.

It is further possible, according to the present invention, to provide the pressure-reduction absorbing panels 5 at the shoulder part of the container as shown in the drawings. In this instance, it is possible to complement the pressure-reduction absorbing panel 2 in such a manner as to ensure a sufficient amount of pressure-reduction compensation, thereby allowing the deformation of the main body portion to be restricted further effectively.

Although the container according to the present invention can be advantageously obtained by a biaxial-stretching blow molding of a thermoplastic resin such as polyethylene terephthalate, the forming method thereof is not particularly limited thereto.

It will be appreciated from the foregoing description that, according to the present invention, the mechanical strength of the container and particularly the rigidity of the grip part can be ensured even when the container is thin-walled for its reduced weight by reducing the resin amount, thereby enabling the initial shape of the container to be stably retained.

It is needless to say that the present invention is not limited to the above-mentioned embodiments, and may be carried out with numerous variants.

The invention claimed is:

1. A pinch grip type bottle-shaped container comprising a container body having opposed recesses formed at sidewall regions of a main body portion of the container body, respectively, to thereby form a grip part of the container by an entire region of the main body portion between the recesses, including the recesses and a back surface region of the main body portion, said bottle-shaped container further comprising:

a pressure-reduction absorbing panel at said back surface region, said pressure-reduction absorbing panel having an upper end arranged at a height substantially coincident with that of an upper end of said grip part; and steps provided along the edges of said recesses forming said grip part, respectively.

2. The bottle-shaped container according to claim 1, wherein said container is provided with a lateral rib having a groove located at a boundary between (1) said upper end of said pressure-reduction absorbing panel in said back surface region and (2) said main body portion of the container body, said groove being convex inwardly of said container.

3. The bottle-shaped container according to claim 2, wherein said container is provided with pressure-reduction absorbing panels at a shoulder part of the container body, which is contiguous with said main body portion.

4. The bottle-shaped container according to claim 1, wherein said container is provided with pressure-reduction absorbing panels at a shoulder part of the container body, which is contiguous with said main body portion.

* * * * *